US010308030B2

(12) United States Patent
Shimano

(10) Patent No.: US 10,308,030 B2
(45) Date of Patent: Jun. 4, 2019

(54) IMAGE RECORDING APPARATUS

(71) Applicant: BROTHER KOGYO KABUSHIKI KAISHA, Nagoya-shi, Aichi-ken (JP)

(72) Inventor: Ayaka Shimano, Nagoya (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 15/920,675

(22) Filed: Mar. 14, 2018

(65) Prior Publication Data

US 2018/0281426 A1 Oct. 4, 2018

(30) Foreign Application Priority Data

Mar. 31, 2017 (JP) ..... 2017-072916

(51) Int. Cl.
*B41J 2/175* (2006.01)
*B41J 29/13* (2006.01)
*B41J 29/38* (2006.01)

(52) U.S. Cl.
CPC ..... *B41J 2/17509* (2013.01); *B41J 2/1752* (2013.01); *B41J 2/1754* (2013.01); *B41J 2/17566* (2013.01); *B41J 29/13* (2013.01); *B41J 29/38* (2013.01)

(58) Field of Classification Search
USPC ..... 347/84, 85, 86, 104
See application file for complete search history.

(56) References Cited

U.S. PATENT DOCUMENTS 8,057,022 B2 * 11/2011 Umeda ..... B41J 2/17513 347/104
8,678,567 B2 * 3/2014 Shimizu ..... B41J 2/17523 347/85
2002/0105565 A1 * 8/2002 Suda ..... B41J 2/17506 347/85
2006/0119671 A1 * 6/2006 Ha ..... B41J 2/17509 347/84
2012/0050359 A1 3/2012 Koganehira et al.

FOREIGN PATENT DOCUMENTS

JP 2012-066563 A 4/2012
JP 2016000505 A 1/2016

* cited by examiner

*Primary Examiner* — Lam S Nguyen
(74) *Attorney, Agent, or Firm* — Scully, Scott, Murphy & Presser, PC

(57) ABSTRACT

A tank is formed with a filling port for filling ink. A cap is attached to the filling port so as to close the filling port. A filling port sensor detects whether the cap is attached to or detached from the filling port. A recorder records an image on a recording sheet by using ink supplied from the tank. An operating interface receives an operation input. A memory stores an ink remaining amount in the tank. A controller controls a recording operation. In response to determining based on a detection signal of the filling port sensor that the cap is detached from the filling port and is again attached to the filling port, the controller receives a first input through the operating interface, the first input indicating that ink is filled into the tank; and updates the ink remaining amount stored in the memory, based on the first input.

11 Claims, 8 Drawing Sheets

FIG. 3

ESTIMATED FILLING AMOUNT TABLE

| CAP OPEN TIMER VALUE Tc (s) | ESTIMATED FILLING AMOUNT Vw (ml) | ESTIMATED VARIATION AMOUNT Vd (ml) |
|---|---|---|
| 30 | 0 | ±0 |
| 31 | 3 | ±0.5 |
| 32 | 6 | ±0.7 |
| ... | ... | ... |
| 35 | 25 | ±3 |
| ... | ... | ... |
| 40 | 120 | ±5 |
| ... | ... | ... |
| 50 | 150 | ±7 |
| ... | ... | ... |
| 66 | 200 | ±9 |
| ... | 200 | ±10 |
| 100 | 200 | ±10 |

17

VARIATION AMOUNT CORRECTION COEFFICIENT TABLE

| INK AMOUNT INDICATED BY INK REMAINING AMOUNT INFORMATION Ir (ml) | CORRECTION LOWER LIMIT COEFFICIENT | CORRECTION UPPER LIMIT COEFFICIENT |
|---|---|---|
| 10 | 1 | 1.8 |
| 11 | 1 | 1.81 |
| 12 | 1 | 1.82 |
| ... | 1 | ... |
| 15 | 1 | 1.5 |
| ... | ... | ... |
| 50 | | 1.1 |
| ... | ... | ... |
| 100 | 1.5 | 1 |
| ... | ... | ... |
| 200 | 1.8 | 1 |

18

HISTORY TABLE

| UPDATE DATE AND TIME | CAP OPEN TIMER VALUE Tc (s) | INK FILLING AMOUNT Vi (ml) |
|---|---|---|
| 2017/1/1 11:15 | 50 | 20 |
| 2017/2/1 11:15 | 39 | 50 |
| 2017/2/13 11:15 | 100 | 200 |
| 2017/3/13 11:15 | 60 | 170 |

19

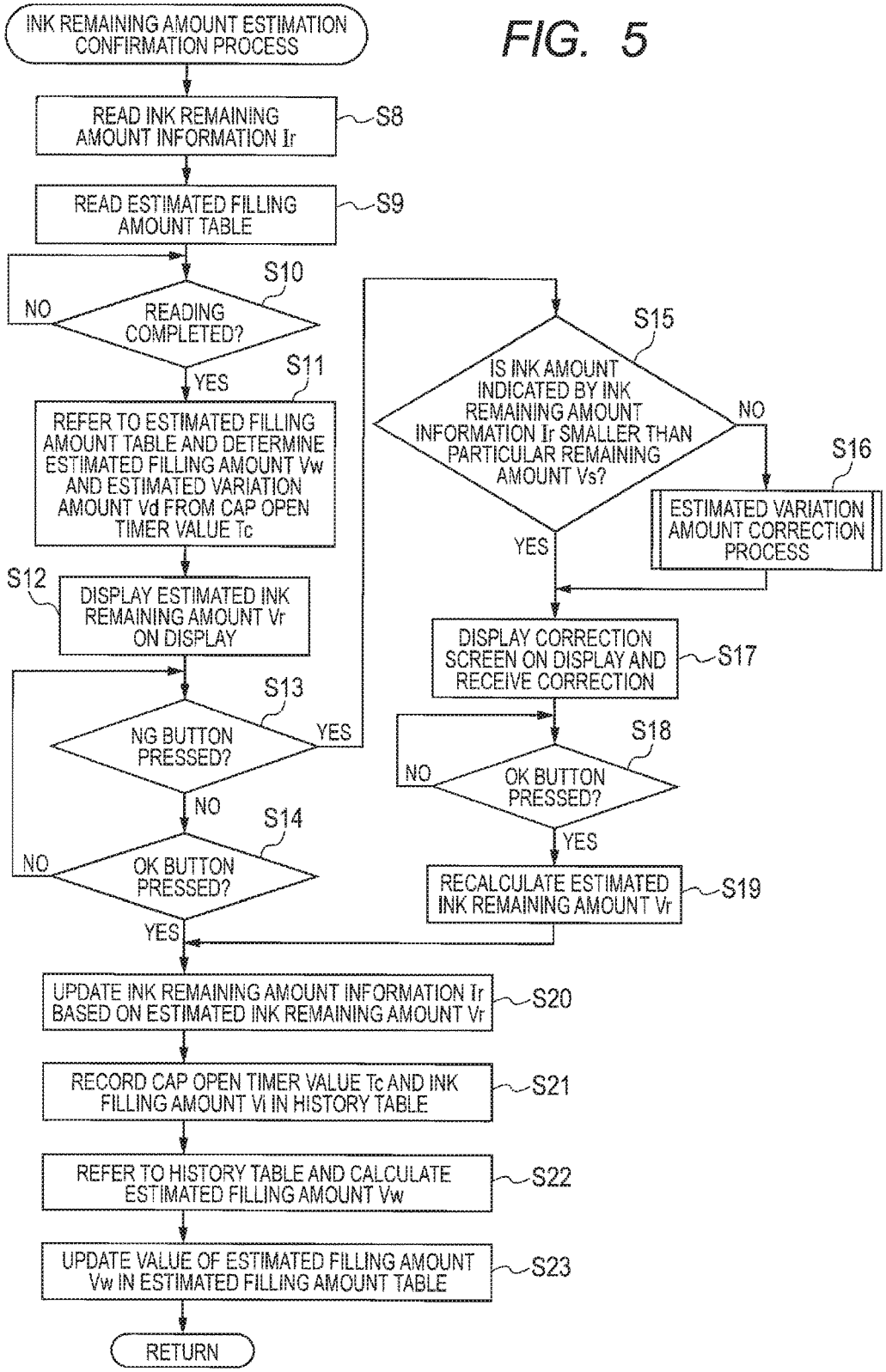
FIG. 5
INK REMAINING AMOUNT ESTIMATION CONFIRMATION PROCESS
READ INK REMAINING AMOUNT INFORMATION Ir
S8
READ ESTIMATED FILLING AMOUNT TABLE
S9
S10
READING COMPLETED?
NO
YES
S11
REFER TO ESTIMATED FILLING AMOUNT TABLE AND DETERMINE ESTIMATED FILLING AMOUNT Vw AND ESTIMATED VARIATION AMOUNT Vd FROM CAP OPEN TIMER VALUE Tc
S12
DISPLAY ESTIMATED INK REMAINING AMOUNT Vr ON DISPLAY
S13
NG BUTTON PRESSED?
YES
NO
S14
OK BUTTON PRESSED?
NO
YES
S15
IS INK AMOUNT INDICATED BY INK REMAINING AMOUNT INFORMATION Ir SMALLER THAN PARTICULAR REMAINING AMOUNT Vs?
NO
YES
S16
ESTIMATED VARIATION AMOUNT CORRECTION PROCESS
DISPLAY CORRECTION SCREEN ON DISPLAY AND RECEIVE CORRECTION
S17
S18
OK BUTTON PRESSED?
NO
YES
RECALCULATE ESTIMATED INK REMAINING AMOUNT Vr
S19
UPDATE INK REMAINING AMOUNT INFORMATION Ir BASED ON ESTIMATED INK REMAINING AMOUNT Vr
S20
RECORD CAP OPEN TIMER VALUE Tc AND INK FILLING AMOUNT Vi IN HISTORY TABLE
S21
REFER TO HISTORY TABLE AND CALCULATE ESTIMATED FILLING AMOUNT Vw
S22
UPDATE VALUE OF ESTIMATED FILLING AMOUNT Vw IN ESTIMATED FILLING AMOUNT TABLE
S23
RETURN

IMAGE RECORDING APPARATUS

CROSS REFERENCE TO RELATED APPLICATIONS

This application claims priority from Japanese Patent Application No. 2017-072916 filed Mar. 31, 2017. The entire content of the priority application is incorporated herein by reference.

TECHNICAL FIELD

This disclosure relates to an image recording apparatus.

BACKGROUND

As an example of an image recording apparatus, a printer is conventionally known that includes a tank in which ink is stored and that ejects, from nozzles, the ink supplied from the tank so as to record an image on a recording sheet.

SUMMARY

According to one aspect, this specification discloses an image recording apparatus. The image recording apparatus includes a tank, a cap, a filling port sensor, a recorder, an operating interface, a memory, and a controller. The tank is configured to store ink therein. The tank is formed with a filling port for filling ink. The cap is configured to be attached to the filling port so as to close the filling port. The filling port sensor is configured to detect whether the cap is attached to the filling port or detached from the filling port. The recorder is configured to record an image on a recording sheet by using ink supplied from the tank. The operating interface is configured to receive an operation input. The memory is configured to store an ink remaining amount in the tank. The controller is configured to control a recording operation of the recorder. The controller is configured to: in response to determining based on a detection signal of the filling port sensor that the cap is detached from the filling port and is again attached to the filling port, receive a first input through the operating interface, the first input indicating that ink is filled into the tank; and update the ink remaining amount stored in the memory, based on the first input.

BRIEF DESCRIPTION OF THE DRAWINGS

Embodiments in accordance with this disclosure will be described in detail with reference to the following figures wherein:

FIG. 3 is a diagram showing tables stored in an EEPROM;

FIG. 5 is a sub-flowchart of an ink remaining amount estimation confirmation process in FIG. 4;

DETAILED DESCRIPTION

In the printer described above, the ink remaining amount information of the tank that is managed by the printer can be corrected by a user at any time. Hence, for example, the ink remaining amount information is corrected irrespective of an operation of replenishing ink to the tank, and thus an error occurs between the corrected ink remaining amount information and the actual ink remaining amount in the tank, with the result that a failure may occur in the operation of the printer.

An example of an object of this disclosure is to prevent the occurrence of an error between the ink remaining amount information of the tank managed by the image recording apparatus and the actual ink remaining amount in the tank.

Some aspects of this disclosure will be described while referring to the accompanying drawings

[External Configuration of MFP]

Figure 1A:
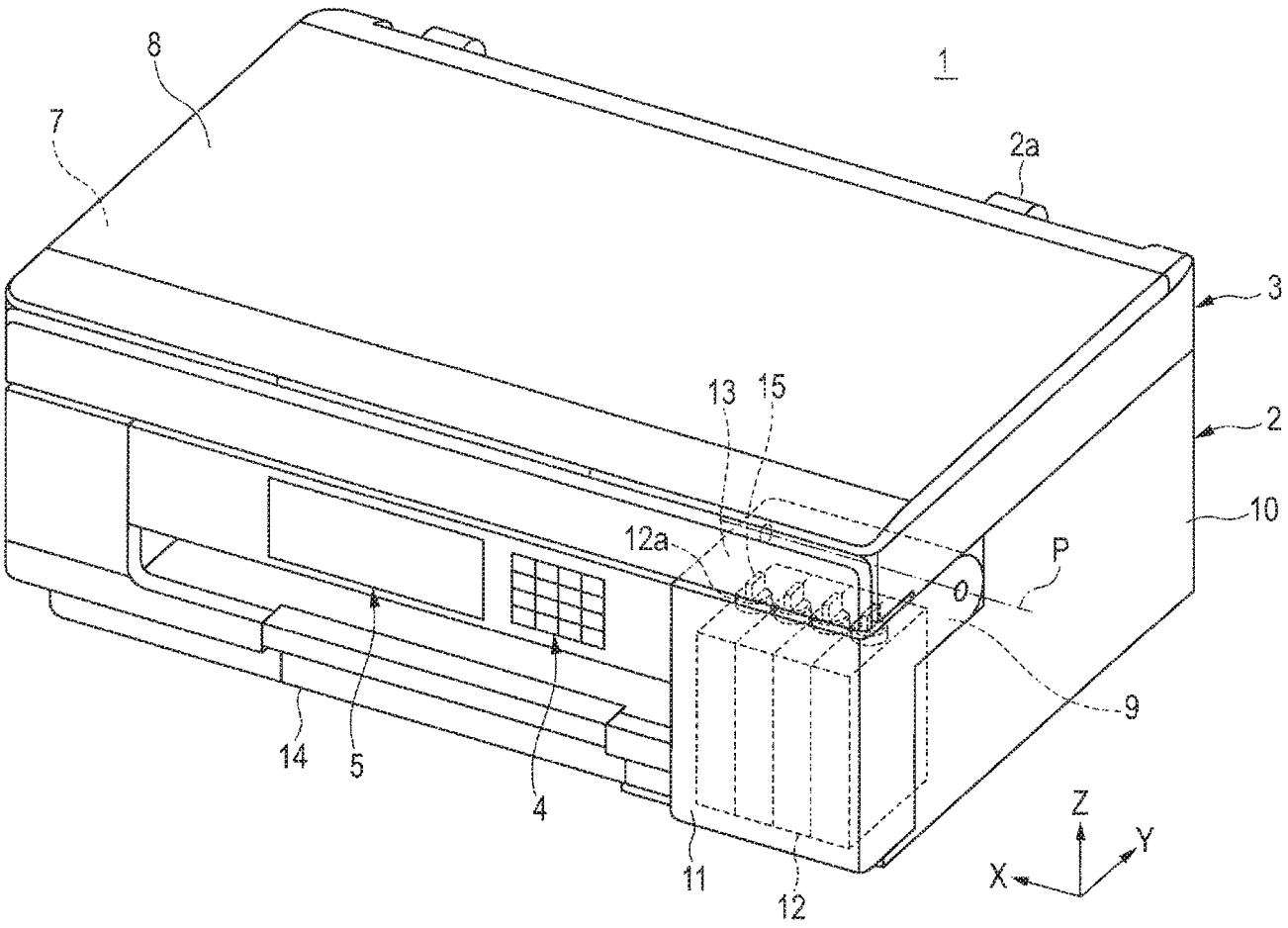
FIG. 1A is an external view of an MFP according to an embodiment.

An MFP 1 shown in FIG. 1A is an example of an image recording apparatus, and has an appearance of the shape of a rectangular parallelepiped in which an X direction is a width direction, a Y direction is a front-rear (depth) direction, and a Z direction is an up-down direction. The MFP 1 includes a printer unit (recorder or print engine) 2, a scanner unit 3, an operation key (operating interface) 4, a display 5, and a control unit 6 (see FIG. 2).

The scanner unit 3 reads an image with an image sensing element so as to generate image data. In the printer unit 2, the generated image data is printed on a recording sheet that is stored within the MFP 1 or is supplied from the outside of the MFP 1. The scanner unit 3 described above is arranged over the printer unit 2 and is coupled to the printer unit 2 with a coupling portion 2*a* that is provided on a rear side of the printer unit 2. Hence, when a front portion of the scanner unit 3 is lifted, the scanner unit 3 is pivotally moved upward about the coupling portion 2*a* serving as a pivot with respect to the printer unit 2, and thus the interior of the printer unit 2 is exposed. The scanner unit 3 includes an original document stage 7 and a lid 8, and the lid 8 is arranged to cover the original document stage 7. The scanner unit 3 reads an image recorded on an original document sheet in a state where the original document sheet is arranged between the original document stage 7 and the lid 8.

The operation key 4 and the display 5 are arranged on an outer portion (here, a front portion) of the MFP 1. The operation key 4 receives an operation input by a user. The display 5 displays particular information for the user. The display 5 is a touch panel type, and further functions as the operating interface with particular timing (S12 to S14, S17 and S18 in a flowchart described later).

The control unit 6 controls the printer unit 2, the scanner unit 3, and the display 5 based on an input from the operation key 4 or an external input through a communication interface (not shown).

The printer unit 2 is controlled by the control unit 6, and uses the ink supplied from a tank 12 so as to record the image on the recording sheet. The printer unit 2 includes a case 10 that forms part of the housing of the MFP 1 and that is formed in the shape of a rectangular parallelepiped. A cover 11 is attached to the case 10. The cover 11 opens and closes an opening communicating with an internal space 13 provided within the case 10. A plurality of tanks 12 is accommodated in the internal space 13. A cap 15 is detachably attached to each tank 12.

The cover 11 is provided in a front portion of the case 10 and, in the present embodiment, is coupled to the case 10 so as to pivotally move in a given range around an imaginary axis line P extending in a horizontal direction (for example, the width direction of the MFP 1). The cover 11 is opened and closed in a state where the scanner unit 3 is lifted from the printer unit 2. When the cover 11 is opened (FIG. 1B), the internal space 13 is exposed. A tray 14 in which the recording sheets are stored is arranged within the case 10. The tray 14 is pulled out forward with respect to the case 10 such that the recording sheets can be replenished. Note that the cover 11 is omitted in FIGS. 1C and 1D for simplicity.

The plurality of tanks 12 is accommodated in the internal space 13 in a state where the tanks 12 are aligned in the width direction. When the cover 11 is opened, the tanks 12 are exposed to the outside. A filling port 12*a* is formed in each tank 12, and the ink that is filled through the filling port 12*a* is stored therein. The filling port 12*a* of the tank 12 in the present embodiment is provided in an upper portion of the tank 12. The cap 15 is detachably attached to the filling port 12*a* so as to close the filling port 12*a*.

Here, when the user replenishes the ink to the tank 12 through the filling port 12*a*, a particular ink replenishment bottle 90 (see FIG. 1D) is used, and the ink flows out from the bottle opening of the bottle substantially at a constant outflow rate so as to be replenished to the tank 12. Hence, by preliminarily grasping the outflow rate of the ink from the bottle opening of the bottle, the ink filling amount can be estimated by measuring a period during which the ink is filled, for example.

As an example, the MFP 1 performs color printing, and the tanks 12 correspond to the ink of respective colors (here, black, yellow, magenta and cyan). The MFP 1 may have a single tank so as to perform only the printing of a single color.

The MFP 1 further includes a cap placement area 9 at which the cap 15 removed from the filling port 12*a* of the tank 12 is placed (see FIGS. 1A to 1D). The cap placement area 9 in the present embodiment is provided in a region of the case 10 that faces the internal space 13 and, as an example, is provided at the rear side of the filling port 12*a*. Here, the cap placement area 9 need not be necessarily provided at the rear side of the filling port 12*a*. The position at which the cap placement area 9 is provided is not limited as long as the cap placement area 9 is provided at the case 10.

[Functional Configuration of MFP]

Figure 2:
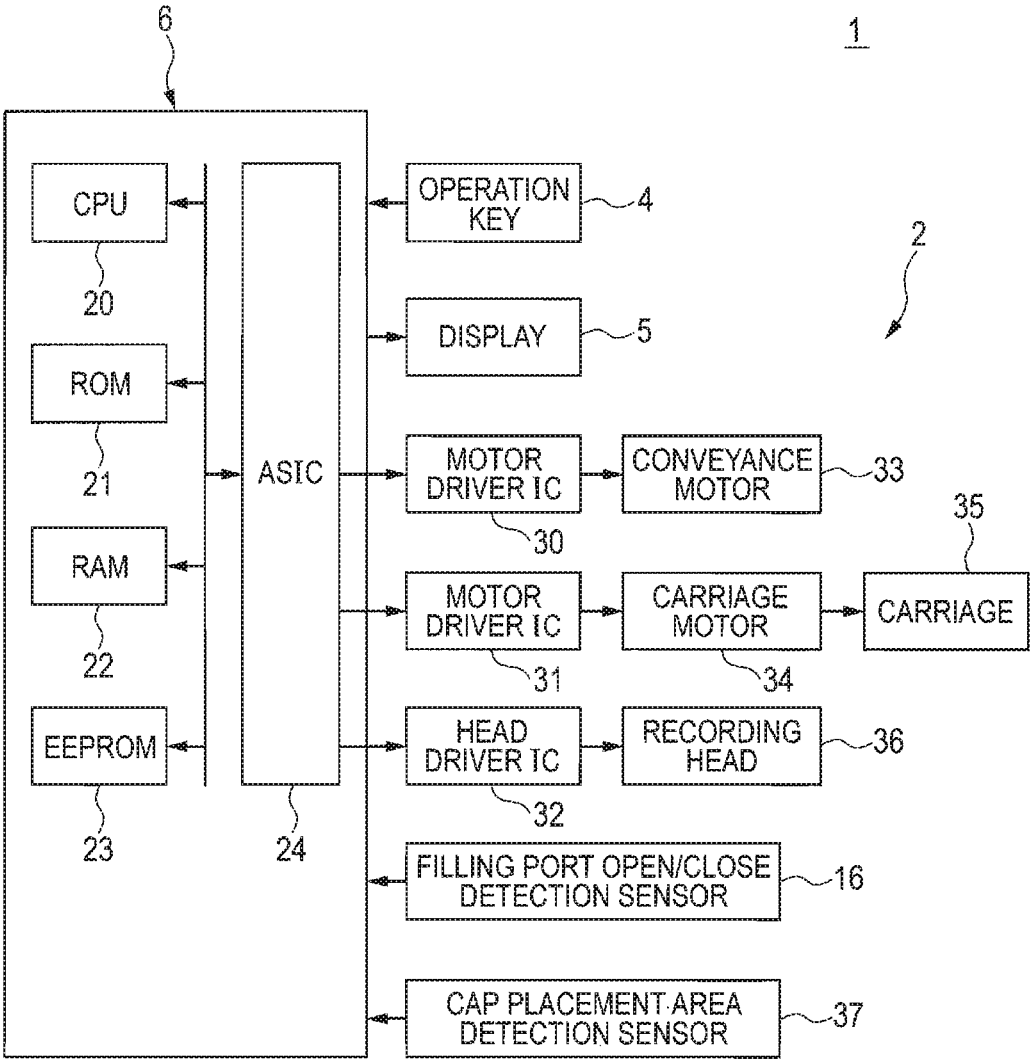
FIG. 2 is a functional block diagram of the MFP in FIG. 1A.

In FIG. 2, the illustration of the configuration of the scanner unit 3 is omitted. As shown in FIG. 2, the MFP 1 includes various sensors, drivers, and so on forming the printer unit 2 in addition to the operation key 4, the display 5, and the control unit 6 described above.

Specifically, the printer unit 2 further includes a filling port open/close detection sensor 16, motor driver ICs 30 and 31, a head driver IC 32, a conveyance motor 33, a carriage motor 34, a carriage 35, a recording head 36, and a cap placement area detection sensor 37. The filling port open/close detection sensor 16 is a sensor for detecting open/close of the filling port 12*a* in the tank 12. Specifically, the filling port open/close detection sensor 16 detects whether the cap 15 is attached to the filling port 12*a* of the tank 12 and also detects whether the ink replenishment bottle 90 is inserted in the filling port 12*a*.

Figure 1B:
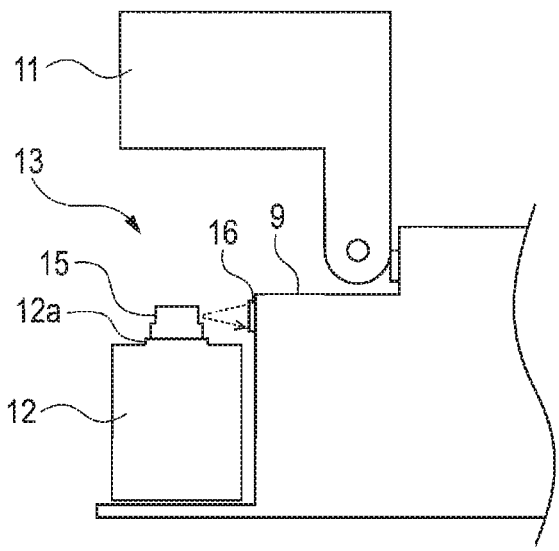
FIG. 1B is an explanatory diagram showing a state where a cap is attached to a filling port of a tank.
Figure 1C:
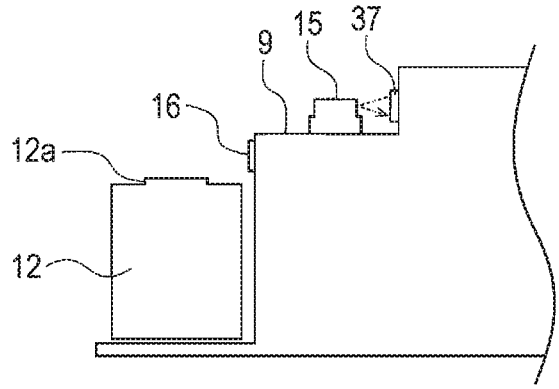
FIG. 1C is an explanatory diagram showing a state where the cap is detached from the filling port of the tank and is placed at a cap placement area.
Figure 1D:
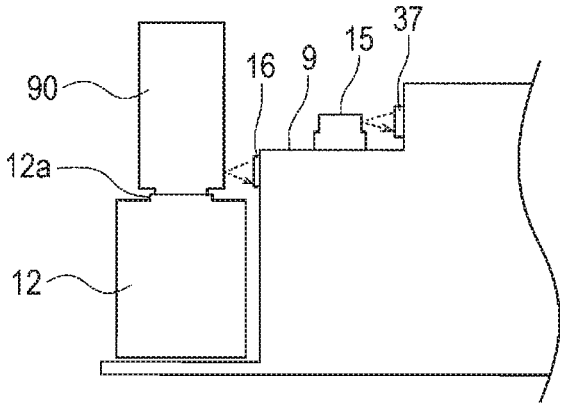
FIG. 1D is an explanatory diagram showing a state where an ink replenishment bottle is inserted in the filling port of the tank.

Various types of sensors may be used as the filling port open/close detection sensor 16, such as an optical sensor and a magnetic sensor, and the filling port open/close detection sensor 16 is not limited to a particular type of sensor. As shown in FIGS. 1B to 1D, in the present embodiment, an optical sensor is used as the filling port open/close detection sensor 16. The filling port open/close detection sensor 16 has a light emitting portion and a light receiving portion. The control unit 6 determines (distinguishes) which of the cap 15 and the ink replenishment bottle 90 closes the filling port 12*a*, based on a difference of output values of the filling port open/close detection sensor 16 at the time when light emitted from the light emitting portion and reflected by the cap 15 or the ink replenishment bottle 90 is received by the light receiving portion. More specifically, the control unit 6 determines (distinguishes) a state where the cap 15 is attached to the filling port 12*a* of the tank 12 (FIG. 1B), a state where none of the cap 15 and the ink replenishment bottle 90 is attached to the filling port 12*a* (FIG. 1C), and a state where the ink replenishment bottle 90 is inserted in the filling port 12*a* (FIG. 1D), based on the difference of the output values of the filling port open/close detection sensor 16. That is the control unit 6 distinguishes these three states from one another.

Alternatively, a magnetic sensor may be used as the filling port open/close detection sensor 16. In this case, too, the control unit 6 similarly determines (distinguishes) the above-mentioned states (FIGS. 1B, 1C, and 1D) based on the difference of the output values of the magnetic sensor.

The cap placement area detection sensor 37 is a sensor for detecting whether the cap 15 is placed at the cap placement area 9. Similar to the filling port open/close detection sensor 16, various types of sensors may be used as the cap placement area detection sensor 37, such as an optical sensor and a magnetic sensor, and the cap placement area detection sensor 37 is not limited to a particular type of sensor.

The filling port open/close detection sensor 16 is provided for each of a plurality of colors, and detects an open/close state of the filling port 12*a* for each color. Similarly, the cap placement area detection sensor 37 is provided for each of the plurality of colors, and detects whether the cap 15 exists at the cap placement area 9 for each color.

As an example, the control unit 6 includes a CPU 20, a memory (a ROM 21, a RAM 22, and an EEPROM 23) and an ASIC 24. The CPU 20 is a controller of the MFP 1 to control the driver ICs 30 to 32 and the display 5. The CPU 20 executes a particular program stored in the ROM 21 so as to also function as a cap open timer for measuring a period that elapses from when the cap 15 is detached from the filling port 12*a* until when the cap 15 is again attached to the filling port 12*a*, and monitors an output value (detection signal) of the filling port open/close detection sensor 16. The CPU 20 described above may be mounted on the control unit 6 as a single processor or mounted as a plurality of processors that cooperates with each other.

The ROM 21 stores a reading control program with which the CPU 20 controls the scanner unit 3 to perform a reading process on an image on an original document sheet and a printing control program with which the CPU 20 controls the printer unit 2 to perform a printing process. The EEPROM 23 stores various types of initial setting information inputted by the user. The motor driver ICs 30 and 31 and the head driver IC 32 are connected to the ASIC 24.

When the CPU 20 receives a print job from the user, the CPU 20 outputs a print command to the ASIC 24 based on the printing control program. The ASIC 24 drives the driver ICs 30 to 32 based on the print command.

For example, the CPU 20 controls the motor driver IC 30 to drive the conveyance motor 33 and thereby convey the recording sheet. The CPU 20 controls the motor driver IC 31 to drive the carriage motor 34 and thereby move the carriage 35.

The CPU 20 controls the head driver IC 32 to eject the ink from the recording head 36 mounted on the moving carriage 35 and thereby print the image data on the recording sheet that is conveyed. In this way, the printing process is performed.

The EEPROM 23 further stores a plurality of tables that are referenced as appropriate by the CPU 20. As shown in FIG. 3, the EEPROM 23 stores an estimated filling amount table 17, a variation amount correction coefficient table 18, and a history table 19.

The estimated filling amount table 17 is used for estimation of the ink remaining amount in the tank 12 by the CPU 20 after the user fills the ink into the tank 12. An estimated filling amount Vw in the estimated filling amount table 17 is associated with a timer value Tc of the cap open timer (see FIG. 4), and indicates an estimation value of the amount of ink filled into the tank 12 corresponding to the timer value Tc. An estimated variation amount Vd in the estimated filling amount table 17 is associated with the estimated filling amount Vw, and indicates a correctable range L (see FIG. 8) in which an estimated ink remaining amount Vr estimated by the CPU 20 is corrected by the user so as to be increased or decreased. It is assumed that, as the timer value Tc is increased, a greater variation in the estimated filling amount Vw is produced. Thus, the estimated filling amount table 17 is set such that, as the estimated filling amount Vw is increased, the estimated variation amount Vd is increased. The CPU 20 uses the estimated filling amount table 17 that is the particular estimation standard described above so as to estimate the ink remaining amount in the tank 12, thereafter updates the estimated filling amount table 17 based on the estimated ink remaining amount Vr corrected through the operating interface (the display 5) and stores the updated value in the EEPROM 23.

The variation amount correction coefficient table 18 is used for adjusting the correctable range L based on ink remaining amount information Ir indicating the current amount of ink in the tank 12. The ink remaining amount information Ir is stored in the RAM 22, and is updated with particular timing. A correction upper limit coefficient and a correction lower limit coefficient in the variation amount correction coefficient table 18 are associated with the amount of ink indicated by the ink remaining amount information Ir, and are used as coefficients for adjusting the correction upper limit value and the correction lower limit value in the correctable range L according to the amount of ink. As the amount of ink indicated by the ink remaining amount information Ir is increased, the correction lower limit coefficient is set higher. As the amount of ink is decreased, the correction upper limit coefficient is set higher.

The history table 19 is used to update the estimated filling amount Vw in the estimated filling amount table 17 based on the ink filling amount Vi corrected by the user within the correctable range L. The timer value Tc in the history table 19 is associated with the ink filling amount Vi. The values in the tables shown in FIG. 3 are merely examples, and may be changed as appropriate.

[Overall Operation of MFP]

Figure 4:
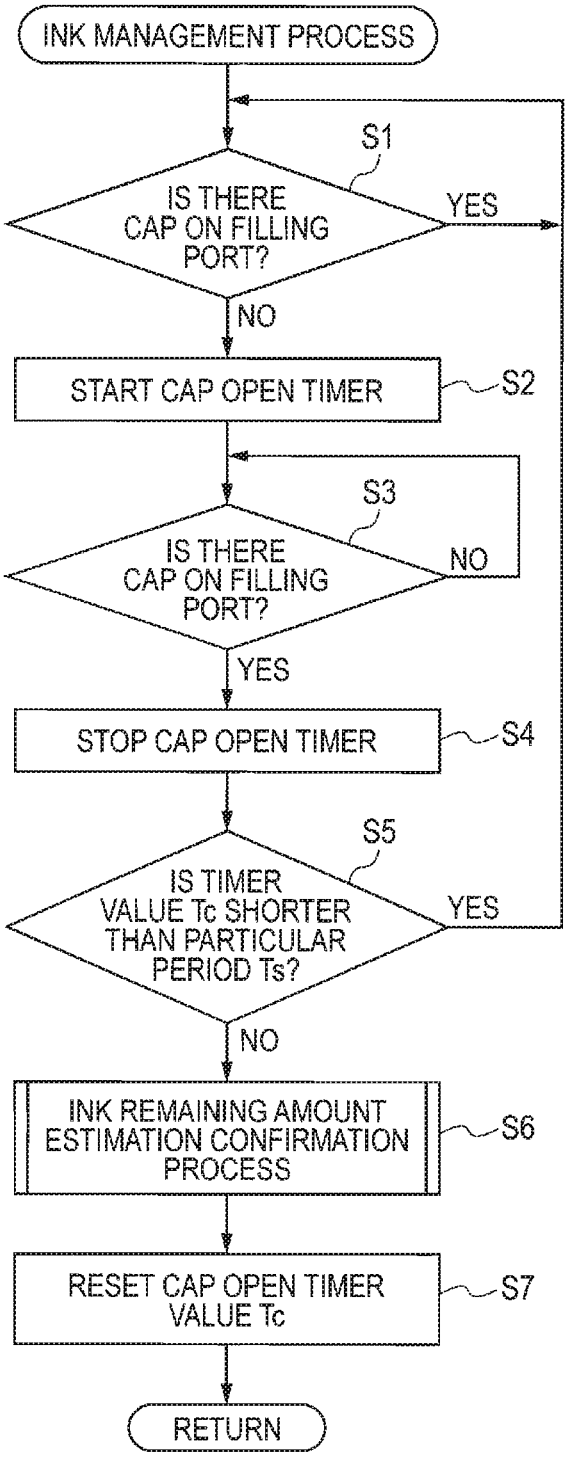
FIG. 4 is a flowchart showing the operation of the MFP in FIG. 1A.

FIG. 4 illustrates the operation of the MFP 1 for one of the plurality of tanks 12, and the same is true for the operation of the MFP 1 for the other tanks 12.

When the MFP 1 is in an energized state, the CPU 20 performs an ink management process of the tank 12 based on the printing control program. Specifically, the CPU 20 determines, based on a detection signal of the filling port open/close detection sensor 16, whether the cap 15 is attached to the filling port 12*a* (step S1, hereinafter simply referred to as S1, and the same is true for the other steps).

When in S1 the CPU 20 determines that the cap 15 is attached to the filling port 12*a*, the CPU 20 returns the process to S1. When in S1 the CPU 20 determines that the cap 15 is not attached to the filling port 12*a*, the CPU 20 starts the cap open timer (S2). Then, the CPU 20 determines whether the cap 15 is attached to the filling port 12*a* (S3), and while the CPU 20 determines that the cap 15 is not attached to the filling port 12*a*, the CPU 20 continues the measurement of the cap open timer. When in S3 the CPU 20 determines that the cap 15 is attached to the filling port 12*a*, the CPU 20 stops the cap open timer (S4).

Then, the CPU 20 determines whether the timer value Tc is less than a particular period Ts that is preliminarily set (S5). The particular period Ts may be set as appropriate with consideration given to, for example, the period that elapses from when the cap 15 is detached from the filling port 12*a* by the user until when the cap 15 is again attached to the filling port 12*a*. The period indicated by the timer value Tc corresponds to a particular duration (hereinafter simply referred to as "duration") that is included in the period that elapses from when the cap 15 is detached from the filling port 12*a* until when the cap 15 is again attached to the filling port 12*a*.

When in S5 the CPU 20 determines that the timer value Tc is less than the particular period Ts, the CPU 20 returns the process to S1. When in S5 the CPU 20 determines that the timer value Tc is not less than the particular period Ts, the CPU 20 performs an ink remaining amount estimation confirmation process described later (S6), resets the timer value Tc (S7), and returns the flow.

In this way, when the timer value Tc is less than the particular period Ts (when it is assumed that the user simply checks the ink in the tank 12), the CPU 20 does not perform the confirmation process (S6). And, only when the timer value Tc is longer than or equal to the particular period Ts (only when it is assumed that the user performs the operation of filling the ink into the tank 12), the CPU 20 performs the confirmation process (S6).

Here, the duration described above is included in the period that elapses from when the cap 15 is detached from the filling port 12*a* until when the cap 15 is again attached to the filling port 12*a*. Hence, the duration is determined based on at least any one of a first period that elapses from when the cap 15 is detached from the filling port 12*a* until when the cap 15 is again attached to the filling port 12*a*, a second period that elapses from when the ink replenishment bottle 90 is inserted into the filling port 12*a* until when the ink replenishment bottle 90 is removed from the filling port 12*a*, and a third period during which the cap 15 is placed at the cap placement area 9 and the ink replenishment bottle 90 is inserted in the filling port 12*a*.

When the second period is measured, for example, whether the ink replenishment bottle 90 is inserted in the filling port 12*a* is detected based on the detection signal of the filling port open/close detection sensor 16. When the third period is measured, whether the cap 15 is placed at the cap placement area 9 is detected based on the detection signal of the cap placement area detection sensor 37. In other words, in this case, the CPU 20 uses the filling port open/close detection sensor 16 and the cap placement area detection sensor 37, and thereby measuring the third period. The MFP 1 may be configured without having the cap placement area 9. In this case, the duration is determined based on at least any one of the first period and the second period.

[Ink Filling Amount Estimation Confirmation Process]

As shown in FIG. 5, in the confirmation process (S6), only when the cap 15 is removed from the filling port 12*a* and is again attached to the filling port 12*a*, the CPU 20 receives an input of a replenishment completion report (declaration) through the operation key 4 indicating that the ink is replenished to the tank 12, and updates, based on the replenishment completion report, the ink remaining amount information Ir stored in the RAM 22.

Only when the duration (the timer value Tc) is longer than or equal to the particular period Ts, the CPU 20 estimates the ink remaining amount in the tank 12 based on the duration, displays the estimated ink remaining amount Vr on the display 5 and further receives, through the display 5 serving as the operating interface, whether the estimated ink remaining amount Vr displayed on the display 5 is correct (or appropriate).

Specifically, the CPU 20 reads the ink remaining amount information Ir from the RAM 22 (S8), and thereafter reads the estimated filling amount table 17 from the EEPROM 23 (S9). When the CPU 20 completes the reading of the estimated filling amount table 17 (S10), the CPU 20 refers to the estimated filling amount table 17, and determines (selects) the estimated filling amount Vw and the estimated variation amount Vd corresponding to the timer value Tc (S11). Thereafter, the CPU 20 displays, on the display 5, the estimated ink remaining amount Vr obtained by adding the estimated filling amount Vw selected in S11 to the amount of ink indicated by the ink remaining amount information Ir (S12).

Figure 7:
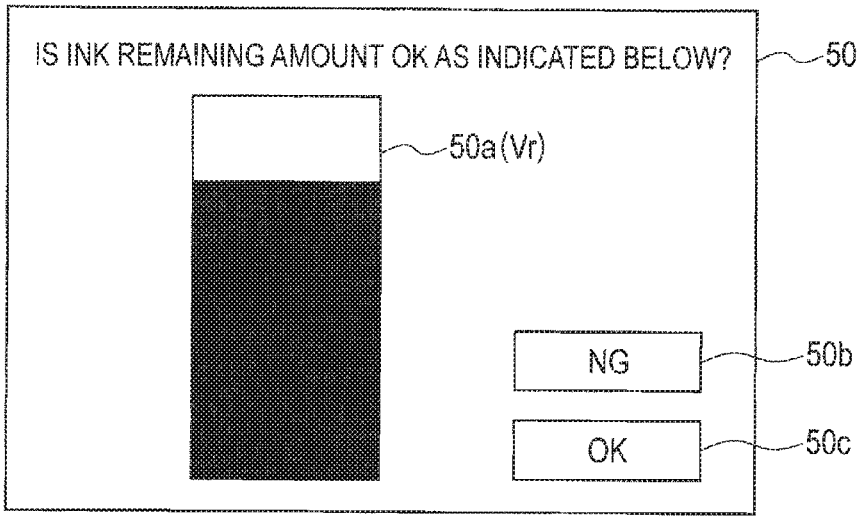
FIG. 7 is a diagram showing a confirmation screen displayed on a display in FIG. 1A.

In S12, the CPU 20 displays a particular confirmation screen 50 (see FIG. 7) on the display 5. The confirmation screen 50 includes a graphic 50*a* that shows the estimated ink remaining amount Vr, an NG (no good) button 50*b* and an OK button 50*c* for prompting the user to select whether the estimated ink remaining amount Vr in the graphic 50*a* is correct.

Then, the CPU 20 determines whether the NG button 50*b* is pressed by the user who looks at the confirmation screen 50 (S13). In response to determining that the NG button 50*b* is not pressed, then the CPU 20 determines whether the OK button 50*c* is pressed (S14). The CPU 20 repeats S13 and S14 until in S14 the CPU 20 determines that the OK button 50*c* is pressed. Here, the CPU 20 in the present embodiment determines that in S14 the OK button 50*c* is pressed, thereby receiving an input of the replenishment completion report.

When in S14 the CPU 20 determines that the OK button 50*c* is pressed, then the CPU 20 updates the ink remaining amount information Ir based on the estimated ink remaining amount Vr in the graphic 50*a* and stores the updated ink remaining amount information Ir in the RAM 22 (S20).

Then, the CPU 20 records, in the history table 19, the timer value Tc of the cap open timer of which counting is stopped in S4. The CPU 20 also records, in the history table 19, the ink filling amount Vi calculated based on the timer value Tc of the cap open timer, thereby recording the history (S21). Here, because the input of replenishment completion report has been received without performing user's correction to the estimated ink remaining amount Vr calculated in S12, the CPU 20 records, as the ink filling amount Vi, the same value as the estimated filling amount Vw selected in S11, in the history table 19. Then, the CPU 20 refers to the history table 19, and newly calculates the estimated filling amount Vw based on the ink filling amount Vi corresponding to the latest timer value Tc and based on the ink filling amount Vi associated with the same timer value Tc as the latest timer value Tc and stored in the history table 19 (S22). The CPU 20 updates the value of the estimated filling amount Vw in the estimated filling amount table 17 with the calculation result in S22 (S23). For example, if the latest timer value Tc=50 s, in S22 the CPU 20 calculates an average value of all the ink filling amounts Vi stored in the history table 19 and associated with the timer value Tc=50 s, and in S23 updates the estimated filling amount Vw with the average value. Note that the method of updating the estimated filling amount Vw is not limited to this. Then, the CPU 20 returns the step.

On the other hand, when in S13 the CPU 20 determines that the NG button 50*b* is pressed, then the CPU 20 determines whether the amount of ink indicated by the ink remaining amount information Ir is smaller than a particular remaining amount Vs that is preliminarily set (S15). The particular remaining amount Vs may be set as appropriate with consideration given to, for example, the number of sheets that can be printed with remaining ink in the MFP 1. When in S15 the CPU 20 determines that the amount of ink indicated by the ink remaining amount information Ir is smaller than the particular remaining amount Vs, the CPU 20 displays a particular correction screen 51 on the display 5 (see FIG. 8), and receives the correction of the estimated ink remaining amount Vr by the user (S17). When in S15 the CPU 20 determines that the amount of ink indicated by the ink remaining amount information Ir is not smaller than the particular remaining amount Vs, the CPU 20 performs S17 after performing an estimated variation amount correction process described later (S16).

In other words, when the user makes a negative selection as to whether the estimated ink remaining amount Vr displayed on the display 5 is correct, in S17 the CPU 20 displays, on the display 5, the correction screen 51 in which the user corrects the estimated ink remaining amount Vr estimated by the CPU 20, and receives an input of the estimated ink remaining amount Vr corrected through the operation key 4.

Figure 8:
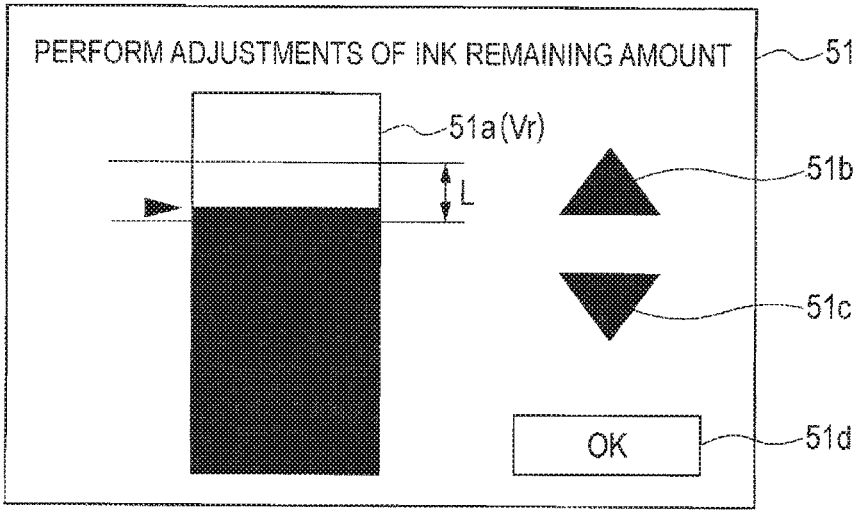
FIG. 8 is a diagram showing a correction screen displayed on the display in FIG. 1A.

As shown in FIG. 8, in S17, the CPU 20 displays the correction screen 51 on the display 5. The correction screen 51 includes a graphic 51*a* that shows the estimated ink remaining amount Vr, amount setting keys 51*b* and 51*c* (an amount increasing key 51*b* and an amount decreasing key 51*c*) for adjustment of the estimated ink remaining amount Vr by the user, and an OK button 51*d*. In the graphic 51*a*, the correctable range L for the estimated ink remaining amount Vr is also displayed. When the amount increasing key 51*b* or the amount decreasing key 51*c* is pressed, the estimated ink remaining amount Vr in the graphic 51*a* is increased or decreased according to the amount of pressing within the correctable range L. The correctable range L corresponds to the upper limit value and the lower limit value of the estimated variation amount Vd at the present time (see FIG. 3).

In the present embodiment, when the ink remaining amount information Ir read in S8 is smaller than the particular remaining amount Vs, the CPU 20 performs S17 without performing the estimated variation amount correction process (S16) described later. In this case, the lower correctable range and the upper correctable range are not extended by the variation amount correction coefficient table 18.

When the ink remaining amount indicated by the ink remaining amount information Ir is smaller than the particular remaining amount Vs, it is likely that the ink remaining amount in the tank 12 after the cap 15 is detached from the filling port 12*a* and again attached to the filling port 12*a* is smaller than a case where the ink remaining amount indicated by the ink remaining amount information Ir is larger than or equal to the particular remaining amount Vs. In S17, if the estimated ink remaining amount Vr of the graphic 51*a* is corrected to be a larger amount than the actual remaining amount, there is a possibility that ink in the tank 12 becomes empty while the MFP 1 is operating. In other words, because the ink remaining amount in the tank 12 recognized by the MFP 1 is larger than the actual remaining amount, the MFP 1 erroneously recognizes that ink still remains and performs printing although ink in the tank 12 is empty. As a result, actuators of the recording head 36 are driven without ejecting ink, and there is a possibility that an image different from print data desired by the user is printed. If the ink remaining amount in the tank 12 is large, there is a long period before the tank 12 becomes empty, and thus there is a possibility that ink is replenished before the tank 12 becomes empty. However, if the ink remaining amount in the tank 12 is small, there is only a short period before the tank 12 becomes empty, and thus there is a high possibility that the actuators of the recording head 36 are driven without ejecting ink.

Thus, when the ink remaining amount information Ir read in S8 is smaller than the particular remaining amount Vs, the CPU 20 sets the upper limit value and the lower limit value of the correctable range L of the graphic 51*a* to the upper limit value and the lower limit value of the estimated variation amount Vd in the estimated filling amount table 17 read in S11, and receives correction by the user (S17). This ensures that, when the ink remaining amount information Ir is smaller than the particular remaining amount Vs, the upper limit value of the correctable range L of the graphic 51*a* is not corrected to be larger than the upper limit value of the estimated variation amount Vd. As a result, in S17, the estimated ink remaining amount Vr is not corrected to exceed the upper limit value of the estimated variation amount Vd shown in the estimated filling amount table 17, which suppresses a possibility that the actuators of the recording head 36 are driven without ejecting ink for a long period.

Then, the CPU 20 determines whether the OK button 51*d* in the correction screen 51 is pressed (S18). In response to determining that the OK button 51*d* is pressed, the CPU 20 determines that a correction completion report of the estimated ink remaining amount by the user has been received. Reception of the correction completion report of the estimated ink remaining amount by the user may also serve as reception of the replenishment completion report. Then, the CPU 20 recalculates the estimated ink remaining amount Vr of the graphic 51*a* corrected in the correction screen 51 (S19). Then, in S20, the CPU 20 updates the ink remaining amount information Ir based on the estimated ink remaining amount Vr recalculated in S19. After that, the CPU 20 records, in the history table 19, the timer value Tc of the cap open timer of which counting is stopped in S4, and also records the ink filling amount Vi, thereby recording the history (S21). More specifically, the CPU 20 calculates the ink filling amount Vi based on the estimated ink remaining amount Vr recalculated in S19, and records the calculated ink filling amount Vi together with the timer value Tc of the cap open timer in the history table 19. After that, the CPU 20 sequentially performs S22 and S23 as described above. Due to these steps, the estimated filling amount Vw in the estimated filling amount table 17 is updated to a more accurate value by receiving the correction by the user.

[Estimated Variation Amount Correction Process]

Figure 6:
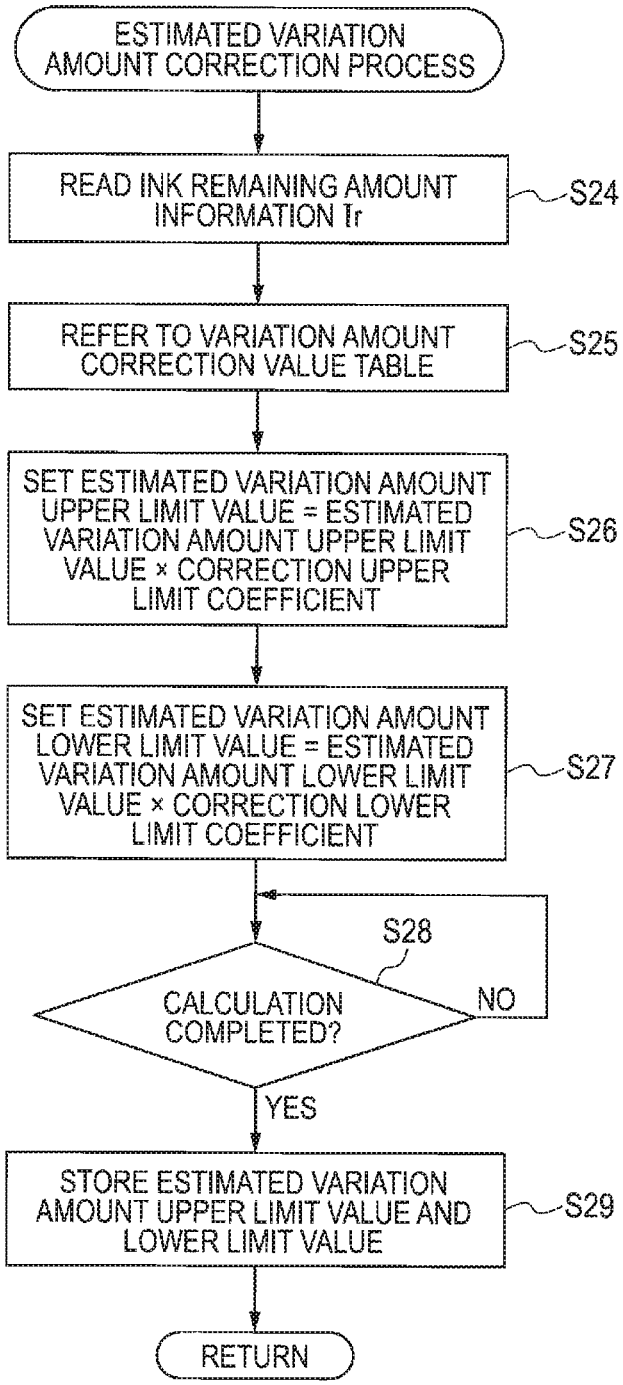
FIG. 6 is a sub-flowchart of an estimated variation amount correction process in FIG. 5.

As shown in FIG. 6, in the estimated variation amount correction process (S16), the CPU 20 makes a setting such that the lower correctable range L of the estimated ink remaining amount Vr of the graphic 51*a* is extended more widely when the ink remaining amount indicated by the estimated ink remaining amount Vr calculated based on the timer value Tc is large, than when the ink remaining amount is small.

An acceptable range of correction of the lower correctable range L in the graphic 51*a* is larger when the estimated ink remaining amount Vr is large, than when the estimated ink remaining amount Vr is small. Thus, in S15, in response to determining that the ink remaining amount indicated by the ink remaining amount information Ir is larger than or equal to the particular remaining amount Vs, the CPU 20 refers to the variation amount correction coefficient table 18 and makes a setting such that the lower correctable range L of the estimated ink remaining amount Vr of the graphic 51*a* is extended more widely when the ink remaining amount indicated by the estimated ink remaining amount Vr is large, than when the ink remaining amount is small. This increases a degree of freedom of correction of the estimated ink remaining amount Vr by the user, and enables more accurate correction of the estimated ink remaining amount Vr.

In the estimated variation amount correction process (S16), the CPU 20 makes a setting such that the upper correctable range L of the estimated ink remaining amount Vr of the graphic 51*a* is extended more widely when the ink remaining amount indicated by the estimated ink remaining amount Vr calculated based on the timer value Tc is small, than when the ink remaining amount is large.

That is, when the CPU 20 performs S16, the ink remaining amount indicated by the ink remaining amount information Ir is larger than or equal to the particular remaining amount Vs. Thus, even if in S17 the estimated ink remaining amount Vr of the graphic 51*a* is corrected to be a larger amount than the actual amount, there is a long period before the tank 12 becomes empty and before the actuators of the recording head 36 are driven without ejecting ink. Hence, there is a higher possibility that ink is replenished before the tank 12 becomes empty than a case where the ink remaining amount indicated by the ink remaining amount information Ir is smaller than the particular remaining amount Vs.

An acceptable range of correction of the upper correctable range L in the graphic 51*a* is larger when the estimated ink remaining amount Vr is small, than when the estimated ink remaining amount Vr is large. Thus, in S15, in response to determining that the ink remaining amount indicated by the ink remaining amount information Ir is larger than or equal to the particular remaining amount Vs, the CPU 20 refers to the variation amount correction coefficient table 18 and makes a setting such that the upper correctable range L of the estimated ink remaining amount Vr of the graphic 51*a* is extended more widely when the ink remaining amount indicated by the estimated ink remaining amount Vr is small, than when the ink remaining amount is large. This increases a degree of freedom of correction of the estimated ink remaining amount Vr by the user, and enables more accurate correction of the estimated ink remaining amount Vr.

Specifically, the CPU 20 reads the ink remaining amount information Ir stored in the EEPROM 23 (S24), and refers to the variation amount correction coefficient table 18 (S25). Then, referring to the variation amount correction coefficient table 18, the CPU 20 multiplies an estimated variation amount upper limit value by the correction upper limit coefficient corresponding to the ink amount indicated by the ink remaining amount information Ir, and sets this value as the new estimated variation amount upper limit value (S26). Further, the CPU 20 multiplies an estimated variation amount lower limit value by the correction lower limit coefficient corresponding to the ink amount indicated by the ink remaining amount information Ir, and sets this value as the new estimated variation amount lower limit value (S27).

Then, the CPU 20 determines whether the calculation in S26 and S27 is completed (S28). When in S28 the CPU 20 determines that the calculation is completed, the CPU 20 stores in the RAM 22 the estimated variation amount upper limit value set in S26 and the estimated variation amount lower limit value set in S27 (S29). Thereafter, the CPU 20 performs S17.

In this way, the estimated variation amount upper and lower limit values newly stored in the RAM 22 are reflected in the correctable range L of the correction screen 51 displayed on the display 5 in S17.

Thus, when the ink remaining amount indicated by the ink remaining amount information Ir read in S8 is larger than or equal to the particular remaining amount Vs, the correctable range L for the user's correction of the estimated ink remaining amount Vr can be appropriately changed depending on the value of the estimated ink remaining amount Vr calculated based on the timer value Tc. Thus, the estimated ink remaining amount Vr can be corrected accurately.

According to the MFP 1 described above, only when the CPU 20 determines, based on the detection signal of the filling port open/close detection sensor 16, that the cap 15 is removed from the filling port 12*a* and is again attached to the filling port 12*a*, the CPU 20 receives the input of the replenishment completion report to the operation key 4 indicating that ink is replenished to the tank 12 and, based on the replenishment completion report, updates the ink remaining amount information Ir stored in the RAM 22. Thus, only when there is a high possibility that the cap 15 is removed and that the operation of replenishing the ink to the tank 12 is performed, the CPU 20 updates the ink remaining amount information Ir of the tank 12. This suppresses an occurrence of an error between the ink remaining amount information Ir of the tank 12 managed by the CPU 20 and the actual ink remaining amount in the tank 12.

Only when the CPU 20 determines, based on the detection signal of the filling port open/close detection sensor 16, that the particular duration (the period indicated by the timer value Tc) included in the period that elapses from when the cap 15 is detached from the filling port 12*a* until when the cap 15 is again attached to the filling port 12*a* is longer than or equal to the particular period Ts, the CPU 20 estimates, from the duration, the ink remaining amount in the tank 12, displays the estimated ink remaining amount Vr on the display 5 and further receives, through the operation key 4, whether the estimated ink remaining amount Vr displayed on the display 5 is correct. This suppresses the occurrence of an error between the estimated ink remaining amount Vr estimated by the CPU 20 and the actual ink remaining amount.

The duration is determined based on at least one of the first period that elapses from when the cap 15 is detached from the filling port 12*a* until when the cap 15 is again attached to the filling port 12*a* and the second period that elapses from when the ink replenishment bottle 90 is inserted into the filling port 12*a* until when the ink replenishment bottle 90 is removed from the filling port 12*a*. Thus, the flexibility of the setting of the duration is enhanced.

The duration is determined based on at least one of the first period that elapses from when the cap 15 is detached from the filling port 12*a* until when the cap 15 is again attached to the filling port 12*a*, the second period that elapses from when the ink replenishment bottle 90 is inserted into the filling port 12*a* until when the ink replenishment bottle 90 is removed from the filling port 12*a*, and the third period during which the cap 15 is placed at the cap placement area 9 and the ink replenishment bottle 90 is inserted in the filling port 12*a*. Thus, the flexibility of the setting of the duration is enhanced.

When the user makes a negative selection on the estimated ink remaining amount Vr displayed on the display 5, the CPU 20 displays, on the display 5, the correction screen 51 in which the user corrects the estimated ink remaining amount Vr estimated by the CPU 20, and receives the input of the estimated ink remaining amount Vr corrected through the operation key 4. This suppresses the occurrence of an error between the estimated ink remaining amount Vr estimated by the CPU 20 and the actual ink remaining amount, by receiving confirmation of the user.

The CPU 20 makes a setting such that the lower correctable range L of the estimated ink remaining amount Vr in the correction screen 50 is extended more widely in a case where there is a large ink remaining amount indicated by the estimated ink remaining amount Vr displayed on the display 5 when the cap 15 is detached from the filling port 12*a*, than a case where the ink remaining amount is small. This ensures (enlarges) the correctable range L, which is for correction by the user, of the estimated ink remaining amount Vr estimated by the CPU 20.

The CPU 20 estimates the ink remaining amount by using the estimated filling amount table 17 that is the particular estimation standard, updates the estimation standard based on the estimated ink remaining amount Vr corrected through the operation key 4, and stores the updated estimation standard in the EEPROM 23. Thus, the CPU 20 appropriately estimates the ink remaining amount in the tank 12.

While the disclosure has been described in detail with reference to the above aspects thereof, it would be apparent to those skilled in the art that various changes and modifications may be made therein without departing from the scope of the claims.

For example, in the estimated filling amount table 17 of the above-described embodiment, the estimated filling amount Vw and the estimated variation amount Vd are stored in association with each other for each timer value Tc. However, there is no limitation to this configuration. For example, instead of the estimated filling amount Vw, a conversion value obtained by converting the estimated filling amount Vw of ink ejected from the recording head 36 into a dot count value may be used. Also, instead of the estimated variation amount Vd, preset variation values (an upper limit variation value and a lower limit variation value) for the above conversion value may be used.

The image recording apparatus of this disclosure is not limited to the MFP and may be applied to various types of apparatuses that use ink stored in a tank so as to record an image.

What is claimed is:

1. An image recording apparatus comprising:

a tank configured to store ink therein, the tank being formed with a filling port for filling ink;

a cap configured to be attached to the filling port so as to close the filling port;

a filling port sensor configured to detect whether the cap is attached to the filling port or detached from the filling port;

a recorder configured to record an image on a recording sheet by using ink supplied from the tank;

an operating interface configured to receive an operation input;

a memory configured to store an ink remaining amount in the tank; and a controller configured to control a recording operation of the recorder, the controller being configured to:

in response to determining based on a detection signal of the filling port sensor that the cap is detached from the filling port and is again attached to the filling port, receive a first input through the operating interface, the first input indicating that ink is filled into the tank; and update the ink remaining amount stored in the memory, based on the first input.

2. The image recording apparatus according to claim 1, further comprising a display configured to display particular information, wherein the controller is configured to:

in response to determining based on the detection signal of the filling port sensor that a particular duration included in a period from when the cap is detached from the filling port until when the cap is again attached to the filling port is longer than or equal to a particular period, estimate an ink remaining amount in the tank from the particular duration;

display the estimated ink remaining amount on the display; and receive a second input through the operating interface, the second input indicating whether the ink remaining amount displayed on the display is correct.

3. The image recording apparatus according to claim 2, wherein the particular duration is determined based on at least one of:

a first period from when the cap is detached from the filling port until when the cap is again attached to the filling port; and a second period from when an ink replenishment bottle is inserted into the filling port until when the ink replenishment bottle is removed from the filling port.

4. The image recording apparatus according to claim 2, further comprising:

a cap placement area at which the cap detached from the filling port is placed; and a cap placement area sensor configured to detect whether the cap is placed at the cap placement area, wherein the controller is configured to measure a period during which the cap is placed at the cap placement area and an ink replenishment bottle is inserted in the filling port, based on detection signals of the filling port sensor and the cap placement area sensor; and wherein the particular duration is determined based on at least one of:

a first period from when the cap is detached from the filling port until when the cap is again attached to the filling port;

a second period from when the ink replenishment bottle is inserted in the filling port until when the ink replenishment bottle is removed from the filling port; and a third period during which the cap is placed at the cap placement area and the ink replenishment bottle is inserted in the filling port.

5. The image recording apparatus according to claim 2, wherein, when a negative selection is made with respect to whether the ink remaining amount displayed on the display is correct, the controller is configured to:

display, on the display, a correction screen for correcting the ink remaining amount estimated by the controller; and receiving a third input through the operating interface, the third input being indicative of the ink remaining amount corrected on the display.

6. The image recording apparatus according to claim 5, wherein the controller is configured to set the correction screen such that a lower correctable range of the ink remaining amount in the correction screen is extended more widely when the ink remaining amount estimated based on the particular duration is large, than when the ink remaining amount is small.

7. The image recording apparatus according to claim 5, wherein the controller is configured to:

estimate the ink remaining amount based on a particular estimation standard;

update the particular estimation standard based on the ink remaining amount corrected through the operating interface; and store the updated estimation standard in the memory.

8. The image recording apparatus according to claim 7, wherein the particular estimation standard stored in the memory includes:

a timer value of a cap open timer for measuring a period that elapses from when the cap is detached from the filling port until when the cap is again attached to the filling port;

an estimated filling amount indicating an estimation value of an amount of ink filled into the tank corresponding to the timer value, the estimated filling amount being associated with the timer value; and an estimated variation amount indicating a correctable range in which an estimated ink remaining amount estimated by the controller is allowed to be corrected through the correction screen, the estimated variation amount being associated with the estimated filling amount.

9. The image recording apparatus according to claim 8, wherein the controller is configured to:

when the second input indicates that the ink remaining amount displayed on the display is correct, record, in a history table in the memory, an ink filling amount calculated based on a latest timer value of the cap open timer;

when the second input indicates that the ink remaining amount displayed on the display is not correct, record, in the history table, the ink filling amount corrected through the correction screen;

calculate the estimated filling amount based on the ink filling amount corresponding to the latest timer value and based on the ink filling amount associated with a same timer value as the latest timer value and stored in the history table, thereby obtaining a calculation result; and update the estimated filling amount in the memory with the calculation result.

10. The image recording apparatus according to claim 5, wherein the controller is configured to:

in response to determining that the ink remaining amount is larger than or equal to a particular remaining amount, set the correction screen such that a lower correctable range of the ink remaining amount in the correction screen is extended more widely when the ink remaining amount estimated based on the particular duration is large, than when the ink remaining amount is small, and set the correction screen such that an upper correctable range of the ink remaining amount in the correction screen is extended more widely when the ink remaining amount estimated based on the particular duration is small, than when the ink remaining amount is large; and in response to determining that the ink remaining amount is smaller than the particular remaining amount, set the correction screen such that the lower correctable range and the upper correctable range are not extended.

11. The image recording apparatus according to claim 1, wherein the controller is configured to determine which of the cap and an ink replenishment bottle closes the filling port, based on a difference of output values of the filling port sensor.

* * * * *